US005792733A

United States Patent [19]

Minami et al.

[11] Patent Number: 5,792,733

[45] Date of Patent: Aug. 11, 1998

[54] ANTIWEAR COMPOSITIONS CONTAINING PHOSPHORUS COMPOUNDS AND OLEFINS

[75] Inventors: Ichiro Minami, Tosayamada, Japan; Hyun-Soo Hong, Moreland Hills; Naresh C. Mathur, Highland Heights, both of Ohio

[73] Assignee: The Lubrizol Corporation, Wickliffe, Ohio

[21] Appl. No.: 911,391

[22] Filed: Aug. 14, 1997

[51] Int. Cl.[6] ..... C10M 137/04; C10M 137/10

[52] U.S. Cl. ..... 508/422; 508/423; 508/433; 508/441

[58] Field of Search ..... 508/433, 441, 508/423, 422

[56] References Cited

U.S. PATENT DOCUMENTS

| | | | |
|---|---|---|---|
| 2,191,996 | 2/1940 | Shoemaker et al. | 87/9 |
| 2,863,834 | 12/1958 | Buckman | 252/32.5 |
| 3,053,341 | 9/1962 | Rounds | 184/1 |
| 3,321,401 | 5/1967 | Ford et al. | 252/46.7 |
| 3,547,821 | 12/1970 | McCoy et al. | 508/441 |
| 3,751,530 | 8/1973 | Oswald et al. | 508/433 |
| 3,843,534 | 10/1974 | Gates et al. | 508/433 |
| 3,903,001 | 9/1975 | Gates | 508/433 |
| 5,104,579 | 4/1992 | Benjamin et al. | 508/441 |
| 5,254,276 | 10/1993 | Benjamin et al. | 252/49.8 |
| 5,681,797 | 10/1997 | Lawate | 508/433 |

FOREIGN PATENT DOCUMENTS

| | | | |
|---|---|---|---|
| 455494 | 3/1949 | Canada . | |
| 35 22 165 C1 | 10/1986 | Germany | 137/2 |

OTHER PUBLICATIONS

Smalheer et al "Lubricant Additives" 1967 (Month Unavailable).

Tribology Letters I 139–146 (1995) I. Minami, "Development of novel lubricity additives: hydroxyalkyl ester of ortho–phenylene phosphate" Month Unavailable.

*Primary Examiner*—Jacqueline V. Howard

*Attorney, Agent, or Firm*—David M. Shold

[57] ABSTRACT

A composition of an oil of lubricating viscosity, a phosphorus compound represented by the formula

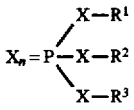

and tautomers thereof, where each X is independently O or S, and an olefin of about 6 to about 30 carbon atoms exhibits improved antiwear performance.

29 Claims, No Drawings

ANTIWEAR COMPOSITIONS CONTAINING PHOSPHORUS COMPOUNDS AND OLEFINS

BACKGROUND OF THE INVENTION

The present invention relates to lubricants having improved antiwear performance.

Phosphorus compounds of various types are known as extreme-pressure/antiwear additives. For instance, I. Minami, "Development of novel lubricity additives," Tribology Letters 1, 139–146, 1995, discloses hydroxyalkylesters of ortho-phenylene phosphate, useful as anti-wear agents. The presence of carbon-carbon double bonds in such molecules enhances the lubricity effects.

U.S. Pat. No. 5,254,276, Benjamin et al., Oct. 19, 1993, discloses diol phosphite adducts of olefins or polymeric olefins as multifunctional lubricants and additives for lubricants.

U.S. Pat. No. 2,863,834, Buckman, Dec. 9, 1958, discloses oil-soluble metal salts of phosphorus-containing reaction products obtained by reacting high molecular weight olefin-diolefin copolymers with a dialkyl hydrogen phosphite.

German Patentschrift DE 35 22 165 Cl (also available as Derwent Abstract 86-285681), published Oct. 30, 1986, discloses lubricants for refrigerators, comprising (A) a base oil of a natural oil such as a naphthenic oils or a synthetic oil such as alkylbenzenes or poly-α-olefins and (B) additives of organic phosphates or organic phosphites and organosilicones.

U.S. Pat. No. 2,191,996, Shoemaker et al., Feb. 27, 1940, discloses the use of aryl and alkyl derivatives of thiophosphites to inhibit corrosion of hard metal alloy bearings in the presence of highly refined lubricating oil.

U.S. Pat. No. 3,053,341, Rounds, Sep. 11, 1962, discloses dialkyl phosphites effective for use as an additive in an automatic transmission fluid.

U.S. Pat. No. 3,321,401, Ford et al., May 23, 1967, discloses lubricating compositions containing a small proportion of an organic phosphite and another oil-soluble organic phosphorus compound.

Canadian patent 455,494, Mar. 29, 1949, discloses a composition of monobutylphosphate, di-butyl-phosphite, and tributyl phosphite, useful as a component in a lubricant for metallic bearing surfaces.

SUMMARY OF THE INVENTION

The present invention provides a composition comprising (a) an oil of lubricating viscosity; (b) an antiwear improving amount of at least one phosphorus compound represented by the formula

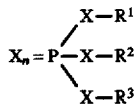

and tautomers thereof, where each X is independently S or O; n is 0 or 1; and $R^1$, $R^2$, and $R^3$ are independently hydrogen atoms, or hydrocarbyl groups, or hydrocarbylene groups which link through an oxygen or sulfur atom to a second P atom to form a dimeric or oligomeric structure, or where two or more of such R groups together form a cyclic hydrocarbylene structure; and (c) a hydrocarbon of about 6 to about 30 carbon atoms having ethylenic unsaturation, present in an amount sufficient to impart improved antiwear performance to the composition of (a) and (b).

DETAILED DESCRIPTION OF THE INVENTION

The materials of the present invention are useful as additives for lubricants in which they can function primarily as antiwear, antiweld, and/or extreme pressure agents. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

As described above, the lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydro-treated mineral oil or a synthetic lubricating oil, such as a polyolefin. Examples of useful oils of lubricating viscosity include XHVI basestocks, such as 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydro-treated paraffinic mineral oil (0.01% sulfur/98 VI), 240N solvent refined/hydro-treated paraffinic mineral oil (0.01% sulfur/98 VI), 80N solvent refined/hydro-treated paraffinic mineral oil (0.08% sulfur/127 VI), and 150N solvent refined/hydro-treated paraffinic mineral oil (0.17% sulfur/127 VI). A description of oils of lubricating viscosity occurs in U.S. Pat. No. 4,582,618 (column 2, line 37 through column 3, line 63, inclusive).

In one embodiment, the oil of lubricating viscosity is a polyalpha-olefin (PAO). Typically, the polyalpha-olefins are derived from monomers having from about 4 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the lubricating composition contains an oil of lubricating viscosity which has an iodine value of less than about 9. Iodine value is determined according to ASTM D-460. In one embodiment, the oil of lubricating viscosity has a iodine value less than about 8, or less than about 6, or less than about 4.

In one embodiment, the oil of lubricating viscosity is selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75 W. The lubricating composition may also have a so-called multigrade rating such as SAE 75 W-80, 75 W-90, 75 W-140, 80 W-90, 80 W-140, 85 W-90, or 85 W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol® 3174 available from The Lubrizol Corporation.

In one embodiment, the oil of lubricating viscosity includes at least one ester of a dicarboxylic acid. Typically the esters containing from about 4 to about 30, preferably from about 6 to about 24, or from about 7 to about 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

An important component of the present invention is at least one phosphorus-containing compound represented by the formula

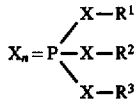

and tautomers thereof. In the above formula each X is independently O or S and n is 0 or 1, corresponding to phosphites, thiophosphites phosphates, and thiophosphates, including mixed materials having, for instance, one or two sulfur atoms, i.e., monothio- or dithio compounds. It is preferred that each of the X are oxygen, and it is likewise preferred that n is 0. However, the material in which n=1 and in which the compound contains one sulfur, which is doubly bonded to the phosphorus atom, is also a preferred species. In the above formula, $R^1$, $R^2$, and $R^3$ are independently hydrogen atoms, or hydrocarbyl groups, or hydrocarbylene groups which link through an oxygen or sulfur atom to a second P atom to form a dimeric or oligomeric structure, or where two or more of such R groups together form a cyclic hydrocarbylene structure. In the case when all the R groups are hydrogen and n is 0, then the phosphorus compound is phosphorous acid or a thiophosphorous acid. If one or more of the R groups is other than hydrogen (as described above) and n is 0, then the compound will be a phosphite ester or a thiophosphite ester. If one or more R groups is hydrogen and n is 0, the compounds can exist in tautomeric forms, for instance:

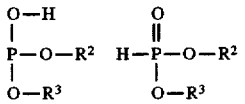

Each of these forms is intended to be encompassed by the general structure set forth above and is likewise intended to be within the scope of the present invention.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the R groups in the above structures together form a cyclic structure. Such materials can be represented, in one embodiment, as

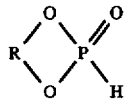

and equivalents. Alternatively, hydrocarbyl groups can serve as hydrocarbylene bridging groups, linking two or more successive phosphorus atoms. Such structures can be illustrated by

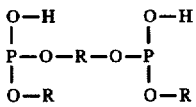

and equivalents thereof.

The hydrocarbyl or hydrocarbylene groups of the present invention generally are alkyl or cycloalkyl groups which contain at least 3 carbon atoms. Preferably they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite wherein $R^1$ is hydrogen and $R^2$ and $R^3$ together form a cyclic hydrocarbylene group containing 4 to 12 carbon atoms. In this structure, the hydrocarbylene group can be seen as being derived from a dihydroxyalkane. Dihydroxyalkanes can also be used to prepare the bridged or linked structures shown above.

Examples of straight chain hydrocarbyl groups include methyl, ethyl, n-propyl, n-butyl, n-hexyl, n-octyl, n-decyl, n-dodecyl, n-tetradecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, tolyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly C12 fatty alcohols; Alfol™ 22+ comprises $C_{18-28}$ primary alcohols having mostly $C_{22}$ alcohols, and so on. Various mixtures of monohydric fatty alcohols derived from naturally occurring triglycerides and ranging in chain length from $C_8$ to $C_{18}$ are available from Procter & Gamble Company. "Neodol™" alcohols are available from Shell Chemical Co., where, for instance, Neodol™ 25 is a mixture of $C_{12}$ and $C_{15}$ alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

Preferred materials include dicyclohexyl hydrogen phosphite, di-n-hexyl hydrogen phosphite, and dibutyl hydrogen phosphite.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain ($C_9$ to $C_{22}$) phosphorus esters have been prepared by reaction of dimethylphosphite with a mixture of medium-chain alcohols by means of a thermal transesterification or an acid- or base-catalyzed transesterification; see for example U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is monounsaturated, that is, containing only a single ethylenic double bond per molecule. The olefin can be a cyclic or a linear olefin. If a linear olefin, it can be an internal olefin or an α-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Other components are also optionally present within the composition of the present invention. Such optional components include conventional additives such as including detergents, dispersants, viscosity index modifiers, sulfurized olefins, corrosion inhibitors, and oxidation inhibitors. Each such material, if present, will be used in customary amounts which will vary with the end use and the particular material in question, but which are well known to those skilled in the art. Typically any such materials may be present in amounts of 0.01 to 60 percent by weight of the composition, preferably 0.1 to 30 percent, and more preferably 0.3 to 10 percent.

In the composition of the present invention, the amount of the oil of lubricating viscosity is not normally limited. If the composition is in the form of a concentrate, the oil can be present in a concentrate-forming amount, which is typically 0.1 to 50 percent by weight of the composition, preferably 0.5 to 20 percent by weight, and more preferably 1 to 5 percent by weight. In an extreme case, the oil of the concentrate may be omitted entirely, being present, then, in an amount of 0 to 50% by weight.

If the present composition is in the form of a finished lubricant formulation, the amount of the oil of lubricating viscosity will typically be at least 20 percent by weight. Preferably the amount will be 50 to 99.5 percent, more preferably 75 to 99 percent, and still more preferably 80 to 95 percent.

The remaining components will be present in generally complementary amounts. The phosphorus compound will be present in an antiwear-improving amount, that is, an amount sufficient to impart improved antiwear properties to the composition when tested by any of a number of conventional antiwear tests. More specifically, the phosphorus component will be present in an amount sufficient to provide 0.005 to 0.5 percent by weight phosphorus (analyzed as P) to the composition, and more preferably 0.01 to 0.2 percent phosphorus. The amount by weight of the phosphorus compound will depend on the molecular weight of the compound. If a molecular weight of 250 is taken as typical for a compound containing 1 phosphorus atom, these amounts correspond to 0.04 to 4, and preferably 0.08 to 1.6 percent by weight. Alternatively, the amount of this component can be expressed in molar terms: 10 to 50 millimoles per kilogram of composition can be typical.

The amount of the olefin component will be an amount suitable to impart further improved antiwear performance, compared to the performance of the material containing the phosphorus compound without the olefin. Typically the ratio of the phosphorus compound (b) to the olefin (c) will be 1:10 to 10:1 on a molar ratio. Preferably the ratio (b):(c) will be 1:3 to 3:1. The amounts by weight of the olefin will, again, depend upon the specific olefin selected. If the olefin is cyclohexene and the phosphorus material has a molecular weight of 250, typical amounts of the olefin can be 0.002 to 0.2 weight percent, preferably 0.005 to 0.05 weight percent.

The total amount of the phosphorus component and the olefin component will typically be 0.05 to 25 or even 50 percent by weight of the composition (for finished lubricant compositions), preferably 0.1 to 10 percent, and more preferably 0.5 to 5 percent. For concentrates, the total amount of these components will typically comprise 30 to 99 percent by weight of the composition, preferably 50 to 97%, more preferably 80 to 95%, and still more preferably 85 to 95%.

The compositions of the present invention can be prepared by simply blending the components by known means, which are not considered critical. Appropriate means of stirring can be employed. The composition, moreover, can be heated if desired to facilitate mixing; however, the heating should not be so extreme that the more volatile components are depleted.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1 (Reference)

A composition is prepared of 20 mmol/kg di-n-hexyl hydrogen phosphite in squalane, which corresponds to 0.062 weight percent phosphorus.

The composition is tested on a pin-on-disk machine. The disks and pins are made of AISI 8620 steel which is hardened to 55–60 HRc. The pin tip radius is 0.0254 m. The test specimens are cleaned with toluene, hexanes, and methanol in an ultrasonic bath prior to testing. Wear tests are carried out a bulk temperatures of 50° C. and 100° C. for one hour at a load of 34.3N and an average sliding speed of 0.85 m/s. The volume of oil tested is 7.2 mL. The wear volumes of the pin are calculated form the decrease in pin length, as measured by a wear scar diameter. The wear volumes of the disk are calculated by a profilometer. The total wear volume is the sum of the wear volume of the pin and the disk. Friction coefficients are obtained from a strain gauge. Two tests are run at each test condition, and if the results differ by more than 15%, additional runs are made. Tested pins are analyzed by scanning electron microscopy and x-ray photoelectron spectroscopy (XPS) to characterize the composition and microstructure of worn surfaces.

The total wear volume of the specimen, tested at 50° C., is $2.13\times10^7$ $\mu m^3$ and at 100° C., $3.55\times10^7$ $\mu m^3$, in contrast with $2.86\times10^7$ $\mu m^3$ and $2.91\times10^7$ $\mu m^3$ for reference tests using untreated squalane at 50 and 100° C., respectively.

The coefficient of friction is 0.11 at 50° C. and 0.09 at 100° C., compared with 0.08 and 0.10, respectively, for the untreated squalane.

Example 2

Example 1 is repeated except that the composition tested also contained 20 mmol/kg of 1-octene. The total wear volume is $1.23\times10^7$ $\mu m^3$ at 50° C. and $1.68\times10^7$ $\mu m^3$ at 100° C. The coefficients of friction are 0.06 and 0.09, respectively.

Example 3

Example 2 is repeated except that in place of the 1-octene, there is used an equimolar amount of cyclohexene. The total wear volume is $0.66\times10^7$ $\mu m^3$ at 50° C. and $1.83\times10^7$ $\mu m^3$ at 100° C. The coefficients of friction are 0.08 and 0.10 respectively.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined. As used herein, the expression "consisting essentially of" permits the inclusion of substances which do not materially affect the basic and novel characteristics of the composition under consideration.

What is claimed is:

1. A composition comprising:

(a) an oil of lubricating viscosity;

(b) an antiwear improving amount of at least one phosphorus compound represented by the formula

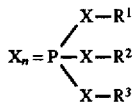

and tautomers thereof, where each X is independently O or S; n is 0 or 1; and $R^1$, $R^1$, and $R^3$ are independently hydrogen atoms, or hydrocarbyl groups, or hydrocarbylene groups which link through an oxygen or sulfur atom to a second P atom to form a dimeric or oligomeric structure, or where two or more of such R groups together form a cyclic hydrocarbylene structure; and (c) a hydrocarbon of about 6 to about 30 carbon atoms having ethylenic unsaturation, present in an amount sufficient to impart improved antiwear performance to the composition of (a) and (b).

2. The composition of claim 1 wherein n is 0 and each X is oxygen.

3. The composition of claim 1 wherein component (b) is a di(hydrocarbyl)hydrogen phosphite, each of the hydrocarbyl groups thereof being alkyl or cycloalkyl groups of at least about 3 carbon atoms.

4. The composition of claim 3 wherein each of the alkyl or cycloalkyl groups contains about 4 to about 24 carbon atoms.

5. The composition of claim 4 wherein each of the alkyl or cycloalkyl groups contains about 5 to about 18 carbon atoms.

6. The composition of claim 5 wherein each of the alkyl or cycloalkyl groups contains 6 carbon atoms.

7. The composition of claim 6 wherein component (b) is di(cyclohexyl)hydrogen phosphite.

8. The composition of claim 1 wherein component (b) is a di(hydrocarbyl)hydrogen phosphite, each of the hydrocarbyl groups thereof being a primary alkyl group.

9. The composition of claim 8 wherein component (b) is dibutyl hydrogen phosphite.

10. The composition of claim 1 wherein component (b) is a di(hydrocarbyl)hydrogen phosphite, each of the hydrocarbyl groups thereof being a secondary alkyl group.

11. The composition of claim 1 wherein component (b) is a triaryl phosphite, a triaryl phosphate, or a triarylthiophosphate.

12. The composition of claim 1 wherein component (b) is a hydrocarbylenehydrogen phosphite wherein $R^1$ is hydrogen and $R^2$ and $R^3$ together form a cyclic hydrocarbylene group containing about 4 to about 12 carbon atoms.

13. The composition of claim 12 wherein the cyclic hydrocarbylene group is derived from a dihydroxyalkane.

14. The composition of claim 1 wherein the hydrocarbon of (c) is monounsaturated.

15. The composition of claim 1 wherein the unsaturated aliphatic or cycloaliphatic hydrocarbon is selected from the group consisting of alkyl-substituted cyclopentenes, hexenes, cyclohexene, alkyl-substituted cyclohexenes, heptenes, cycloheptenes, alkyl-substituted cycloheptenes, octenes, cyclooctenes, alkyl-substituted cyclooctenes, nonenes, decenes, undecenes, dodecenes, tridecenes, tetradecenes, pentadecenes, hexadecenes, heptadecenes, octadecenes, cyclooctadiene, norbornene, dicyclopentadiene, squalene, diphenylacetylene, and styrene.

16. The composition of claim 1 wherein the unsaturated aliphatic or cycloaliphatic hydrocarbon is cyclohexene or 1-octene.

17. The composition of claim 1 wherein the amount of the oil of lubricating viscosity is about 50 to about 99.5 percent by weight.

18. The composition of claim 17 wherein the amount of the oil of lubricating viscosity is about 75 to about 99 percent by weight.

19. The composition of claim 18 wherein the amount of the oil of lubricating viscosity is about 80 to about 95 percent by weight.

20. The composition of claim 1 wherein the composition contains about 0.005 to about 0.5 percent by weight phosphorus derived from component (b).

21. The composition of claim 20 wherein the composition contains about 0.01 to about 0.1 percent by weight phosphorus derived from component (b).

22. The composition of claim 1 wherein components (b) and (c) are present in molar ratios of about 1:10 to about 10:1.

23. The composition of claim 22 wherein components (b) and (c) are present in molar ratios of about 1:3 to about 3:1.

24. A composition prepared by admixing the components of claim 1.

25. A method for improving the antiwear properties of a composition of (a) an major amount of an oil of lubricating viscosity and (b) an antiwear-improving amount of at least one phosphorus compound represented by the formula

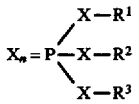

and tautomers thereof, where each X is independently S or O; n is 0 or 1; and $R^1$, $R^2$, and $R^3$ are independently hydrogen atoms, or hydrocarbyl groups, or hydrocarbylene groups which link through an oxygen or sulfur atom to a second P atom in a dimeric or oligomeric structure, or where two or more of such R groups together form a cyclic hydrocarbylene structure; said method comprising:

including in the composition (c) a hydrocarbon of about 6 to about 30 carbon atoms having ethylenic unsaturation, present in an amount sufficient to impart improved antiwear performance to the composition of (a) and (b).

26. A method for lubricating a surface, comprising supplying to the surface the composition of claim 1.

27. A concentrate comprising:

(a) about 1 to about 50% of an oil of lubricating viscosity;

(b) at least one phosphorus compound represented by the formula

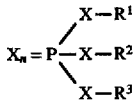

and tautomers thereof, where each X is independently S or O; n is 0 or 1; and $R^1$, $R^2$, and $R^3$ are independently hydrogen atoms, or hydrocarbyl groups, or hydrocarbylene groups which link through an oxygen or sulfur atom to a second P atom to form a dimeric or oligomeric structure, or where two or more of such R groups together form a cyclic hydrocarbylene structure; and (c) a hydrocarbon of about 6 to about 30 carbon atoms having ethylenic unsaturation, wherein components (b) and (c) are present in relative amounts of about 1:10 to about 10:1 by weight and where (b) and (c) together comprise about 30 to about 99 percent by weight of the concentrate.

28. The concentrate of claim 27 wherein the amount of the oil of lubricating viscosity is about 3 to about 20 percent by weight.

29. A concentrate comprising:

(a) 0 to about 50% of an oil of lubricating viscosity;

(b) at least one phosphorus compound represented by the formula

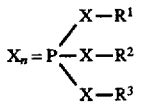

and tautomers thereof, where each X is independently S or O; n is 0 or 1; and $R^1$, $R^2$, and $R^3$ are independently hydrogen atoms, or hydrocarbyl groups, or hydrocarbylene groups which link through an oxygen or sulfur atom to a second P atom to form a dimeric or oligomeric structure, or where two or more of such R groups together form a cyclic hydrocarbylene structure;

(c) a hydrocarbon of about 6 to about 30 carbon atoms having ethylenic unsaturation, wherein components (b) and (c) are present in relative amounts of about 1:10 to about 10:1 by weight and where (b) and (c) together comprise about 30 to about 99 percent by weight of the concentrate; and (d) a customary amount of an additive selected from the group consisting of detergents, dispersants, viscosity index modifiers, sulfurized olefins, corrosion inhibitors, and oxidation inhibitors.

* * * * *